US008265852B2

(12) United States Patent
Yanakiev et al.

(10) Patent No.: US 8,265,852 B2
(45) Date of Patent: Sep. 11, 2012

(54) TEMPERATURE CONTROL SYSTEM AND METHOD FOR PARTICULATE FILTER REGENERATION USING A HYDROCARBON INJECTOR

(75) Inventors: Ognyan N. Yanakiev, Canton, MI (US); Charles E. Solbrig, Ypsilanti, MI (US)

(73) Assignee: GM Global Technology Operations LLC

( * ) Notice: Subject to any disclaimer, the term of this patent is extended or adjusted under 35 U.S.C. 154(b) by 636 days.

(21) Appl. No.: 12/464,975

(22) Filed: May 13, 2009

(65) Prior Publication Data

US 2010/0076666 A1 Mar. 25, 2010

Related U.S. Application Data

(60) Provisional application No. 61/098,546, filed on Sep. 19, 2008.

(51) Int. Cl.
*G06F 19/00* (2011.01)
*F01N 3/025* (2006.01)
*F01N 3/20* (2006.01)

(52) U.S. Cl. ..... 701/102; 60/286; 60/295; 60/297; 60/303; 60/311

(58) Field of Classification Search ..... 701/101–103, 701/109, 114; 60/274, 276, 277, 285, 286, 60/295, 297, 303, 311
See application file for complete search history.

(56) References Cited

U.S. PATENT DOCUMENTS

| | | | | |
|---|---|---|---|---|
| 6,973,776 | B2 | 12/2005 | van Nieuwstadt et al. | |
| 7,047,729 | B2 | 5/2006 | van Nieuwstadt et al. | |
| 7,246,005 | B2 * | 7/2007 | Johnson | 701/111 |
| 2005/0091968 | A1 | 5/2005 | van Nieuwstadt et al. | |
| 2008/0141660 | A1 * | 6/2008 | Kim et al. | 60/286 |
| 2009/0107118 | A1 * | 4/2009 | Ruona | 60/286 |
| 2010/0132334 | A1 * | 6/2010 | Duclos et al. | 60/286 |

FOREIGN PATENT DOCUMENTS

| | | | | |
|---|---|---|---|---|
| EP | 1669565 | A1 * | 6/2006 | 60/277 |
| JP | 2006009675 | A * | 1/2006 | 60/311 |
| WO | WO2005/005797 | | 1/2005 | |

OTHER PUBLICATIONS

German Office Action dated Dec. 22, 2010 for German Application No. 102009041688.9-13, 6 pages.

* cited by examiner

*Primary Examiner* — Willis Wolfe, Jr.

(57) ABSTRACT

A control system includes a first module, a fuel determination module, a temperature error correction module, and a hydrocarbon injection control module. The first module determines a temperature difference between a desired inlet temperature of a particulate filter (PF) and an outlet temperature of a first catalyst. The fuel determination module determines an uncorrected desired fuel value based on the temperature difference, an ambient temperature, and a mass flow of exhaust gas. The temperature error correction module generates a desired fuel value based on the uncorrected desired fuel value. The hydrocarbon injection control module controls a hydrocarbon injector based on the desired fuel value.

20 Claims, 3 Drawing Sheets

TEMPERATURE CONTROL SYSTEM AND METHOD FOR PARTICULATE FILTER REGENERATION USING A HYDROCARBON INJECTOR

CROSS-REFERENCE TO RELATED APPLICATIONS

This application claims the benefit of U.S. Provisional Application No. 61/098,546, filed on Sep. 19, 2008, which is incorporated herein by reference in its entirety.

FIELD

The present disclosure relates to an engine control system and method, and more particularly to a control system that controls delivery of fuel to adjust a temperature of a particulate filter.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Diesel engines combust diesel fuel and air to produce power. The combustion of diesel fuel produces exhaust gas that contains particulate matter. The particulate matter may be filtered from the exhaust gas using a particulate filter (PF). Over time, the particulate matter may accumulate within the PF and may restrict the flow of exhaust gas through the PF. Particulate matter that has collected within the PF may be removed by a process referred to as regeneration. During regeneration, particulate matter within the PF may be combusted.

Regeneration may be accomplished, for example, by injecting fuel into the flow of exhaust gas upstream from the PF. One or more catalysts may be arranged upstream from the PF. The combustion of the injected fuel by the catalysts generates heat, thereby increasing the temperature of the exhaust gas. The increased temperature of the exhaust gas may cause the particulate matter accumulated within the PF to combust.

SUMMARY

A control system includes a first module, a fuel determination module, a temperature error correction module, and a hydrocarbon injection control module. The first module determines a temperature difference between a desired inlet temperature of a particulate filter (PF) and an outlet temperature of a first catalyst. The fuel determination module determines an uncorrected desired fuel value based on the temperature difference, an ambient temperature, and a mass flow of exhaust gas. The temperature error correction module generates a desired fuel value based on the uncorrected desired fuel value. The hydrocarbon injection control module controls a hydrocarbon injector based on the desired fuel value.

A method includes determining a temperature difference between a desired inlet temperature of a particulate filter (PF) and an outlet temperature of a first catalyst; determining an uncorrected desired fuel value based on the temperature difference, an ambient temperature, and a mass flow of exhaust gas; generating a desired fuel value based on the uncorrected desired fuel value; and controlling a hydrocarbon injector based on the desired fuel value.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
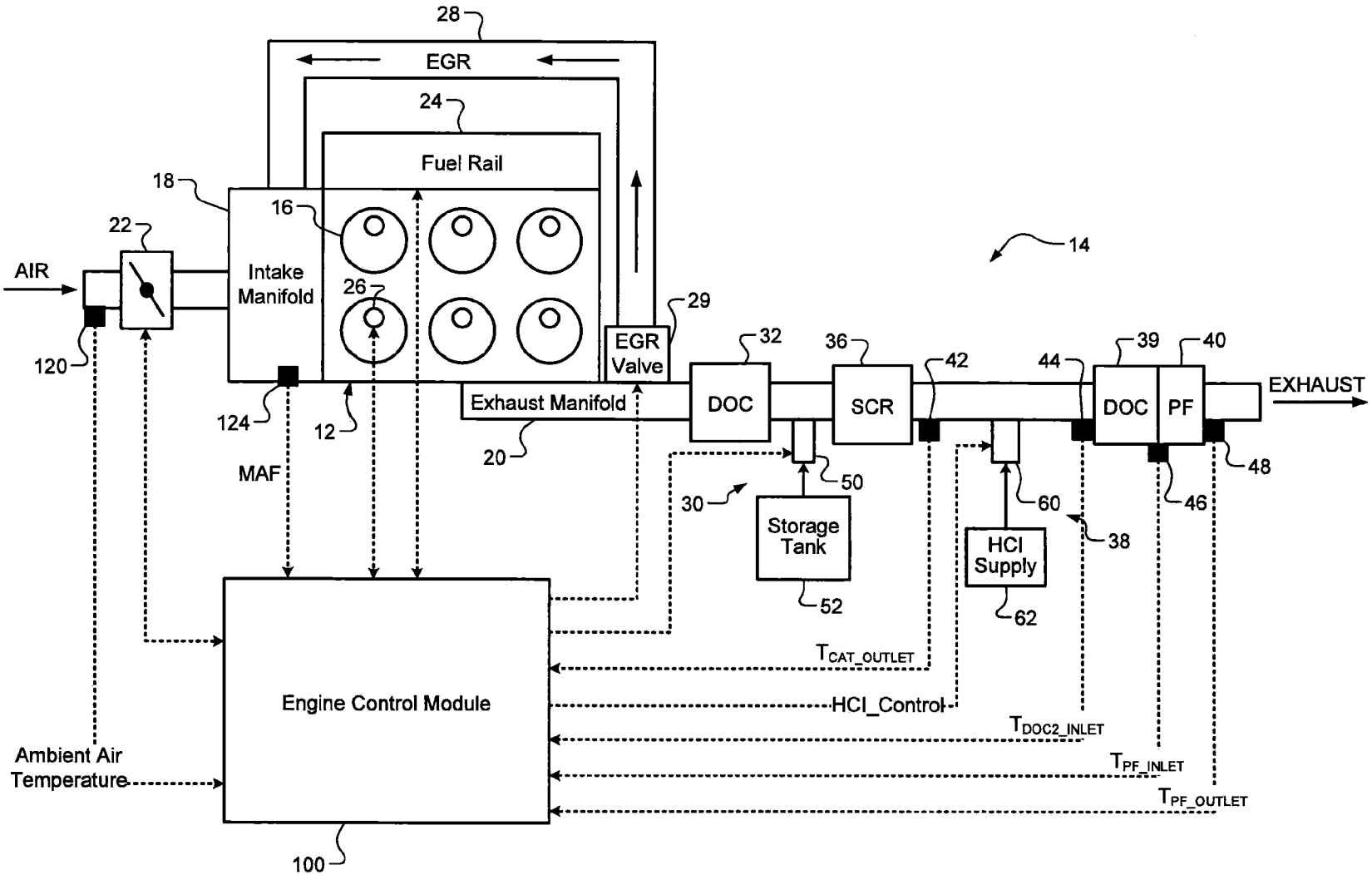
FIG. 1 is a functional block diagram of an exemplary engine system according to the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

While the present disclosure will be described in conjunction with a diesel engine, the present disclosure also applies to other types of engines including naturally aspirated and forced induction internal combustion engines. Referring now to FIG. 1, an exemplary engine system is shown. The engine system includes a diesel engine 12 and an exhaust treatment system 14. The diesel engine 12 includes a plurality of cylinders 16, an intake manifold 18 and an exhaust manifold 20.

Airflows into the intake manifold 18. A throttle 22 may be positioned before the intake manifold 18. The air is mixed with fuel and the air/fuel (A/F) mixture is combusted within the cylinders 16 to drive pistons (not shown), which rotate a crankshaft (not shown) that is coupled to a transmission (not shown). Although six cylinders 16 are shown, the diesel engine 12 may include more or fewer cylinders. The fuel may be provided by a fuel rail 24 and may be injected into the air stream and/or directly into the cylinders 16 using fuel injectors 26.

Exhaust gas is produced by the combustion process (e.g. compression ignition for diesel engines) and is vented from the cylinders 16 into the exhaust manifold 20. The engine system 10 may include an exhaust gas recirculation (EGR) system 28 that circulates exhaust gas back to the intake manifold 18. The EGR system 28 may be controlled by an EGR valve 29. Turbochargers and/or superchargers (not shown) may be used to force more air into the cylinders 16. The exhaust treatment system 14 treats the exhaust gas.

The exhaust treatment system 14 may include a reductant dosing system 30, a first diesel oxidation catalyst (DOC) 32, a selective catalytic reduction (SCR) catalyst 36, a hydrocarbon injection (HCI) system 38, a second DOC 39, and a particulate filter (PF) 40. In various implementations, the SCR catalyst 36 may be supplemented or replaced by a lean NOx trap (not shown).

As the exhaust gas passes through the first DOC 32, the first DOC 32 oxidizes carbon monoxide and hydrocarbons and reduces nitrogen oxides (NOx) in the exhaust gas. The dosing system 30 selectively supplies reductant to the exhaust gas upstream from the SCR catalyst 36. For example only, the reductant may include ammonia or urea. The reductant reacts with NOx in the exhaust gas and creates carbon dioxide while reducing NOx.

Over time, the particulate matter reaching the PF 40 may accumulate within the PF 40 and may restrict the flow of exhaust gas through the PF 40. Particulate matter that has collected within the PF 40 may be removed during regeneration. The HCI system 38 selectively injects fuel upstream from the second DOC 39 to increase the exhaust gas temperature. The exhaust gas temperature changes in response to the amount of fuel injected.

Additionally, the exhaust treatment system 14 may include temperature sensors 42, 44, 46, and 48 (collectively referred to as temperature sensors 42-48) that are located at various points along the emissions path. For example, the temperature sensor 42 may be located at the outlet of the SCR catalyst 36 and generates $T_{CAT_OUTLET}$. When a lean NOx trap is present, the temperature sensor 42 may be located at an outlet of the lean NOx trap.

The temperature sensor 44 may be located near an inlet of the second DOC 39 and generates $T_{DOC2_INLET}$. The temperature sensor 46 may be located between an outlet of the second DOC 39 and an inlet of the PF 40 and generates $T_{PF_INLET}$. The temperature sensor 48 may be located downstream from the PF 40 and generates $T_{PF_OUTLET}$. For example, the temperature sensors 42-48 may be used for feedback-based control of the exhaust treatment system 14. Additional temperature sensors and other sensors may be used. For example only, a temperature sensor (not shown) may be located upstream from the first DOC 32.

The dosing system 30 may include an injector 50 and a storage tank 52. The dosing system 30 selectively injects the reductant. An injection rate of the reductant may be controlled based on feedback from one or more sensors. For example only, NOx sensors (not shown) may be used to determine NOx conversion efficiency. The amount of reductant may be determined in response to the NOx conversion efficiency or other factors. The NOx sensors may be arranged upstream and/or downstream from the SCR catalyst 36. Alternately, NOx levels may be estimated based on models, tables, or other parameters. The reductant reacts with NOx in the exhaust gas and creates carbon dioxide, thereby reducing NOx levels.

The HCI system 38 includes an HCI injector 60 and an HCI supply 62. The HCI supply 62 may be a vehicle fuel tank or a separate reservoir. A pump (not shown) may be used to increase fuel supply pressure if needed. During regeneration, the HCI system 38 injects fuel that is combusted in the second DOC 39, which increases the temperature of the exhaust gas. The temperature increase is related to the amount of fuel injected. When the hot exhaust gas flows into the PF 40, the temperature of the PF 40 increases. When the temperature of the PF 40 exceeds a regeneration temperature, particulate matter in the PF 40 begins to combust. The burning particulate matter may create a flame front that cascades down the length of the PF 40.

The engine system 10 may include an engine control module 100. The engine control module 100 may be a stand alone module or part of another vehicle control module such as an engine or transmission control module. The engine control module 100 controls operation of the engine based on driver inputs and sensed parameters.

Figure 2:
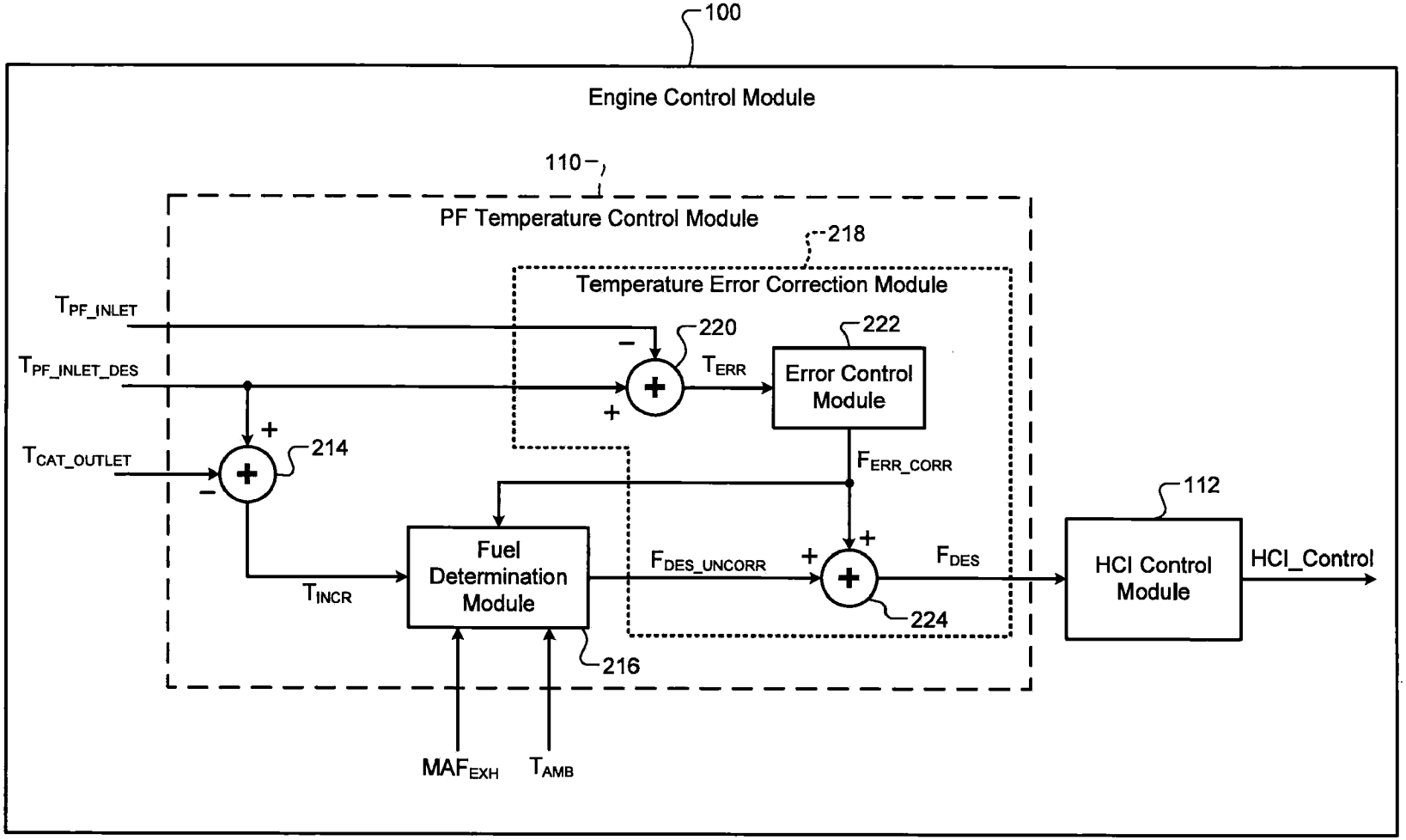
FIG. 2 is a functional block diagram of an exemplary implementation of the engine control module according to the present disclosure.

With respect to FIG. 2, a functional block diagram of an exemplary implementation of the engine control module 100 is shown. The engine control module 100 includes a PF temperature control module 110 that determines a desired fuel injection value $F_{DES}$ based on a desired temperature of the PF 40. An HCI control module 112 controls delivery of fuel by the HCI injector 60 using a signal HCI_Control based on the desired fuel value $F_{DES}$. The amount of fuel injected by the HCI injector 60 influences the temperature of the exhaust gas exiting the second DOC 39. Higher exhaust gas temperatures result in higher PF 40 temperatures.

The PF temperature control module 110 may determine $F_{DES}$ based on temperature values from the temperature sensors 42-48, an exhaust mass airflow (MAF) value $MAF_{EXH}$, ambient temperature value $T_{AMB}$, and/or other parameters. $T_{AMB}$ may be measured by a sensor arranged in any suitable location. For example, an ambient temperature sensor 120 may measure a temperature of intake air. The engine control module 100 may calculate $MAF_{EXH}$ based on an intake MAF value generated by an intake MAF sensor 124. The $MAF_{EXH}$ value may also be based on desired fuel flow.

The engine control module 100 may selectively enable regeneration of the PF 40. The engine control module 100 may enable regeneration when various conditions are detected. For example only, the engine control module 100 may enable regeneration when the vehicle has been operated for a predetermined period and/or has traveled a predetermined distance. Alternatively, the engine control module 100 may enable regeneration based on $MAF_{EXH}$, engine load, and/or other conditions. For example only, regeneration may be enabled when the $MAF_{EXH}$ value is less than a predetermined value and/or when the engine is operating at a predetermined load.

The engine control module 100 may also enable regeneration based on other criteria. For example, the engine control module 100 may enable regeneration based on a comparison of a predetermined temperature with $T_{CAT_OUTLET}$ from the temperature sensor 42. When $T_{CAT_OUTLET}$ is less than the predetermined temperature, the engine control module 100 may disable regeneration.

The engine control module 100 determines a desired PF inlet temperature value $T_{PF_INLET_DES}$ based on whether regeneration is enabled. When the PF 40 exceeds the regeneration temperature, particulate matter in the PF 40 begins to combust, thereby regenerating the PF 40. The engine control module 100 may set $T_{PF_INLET_DES}$ to the regeneration temperature or to a temperature that maintains an ongoing regeneration process.

A summing module 214 of the PF temperature control module 110 determines a desired temperature increase value ($T_{INCR}$) based on a difference between $T_{PF_INLET_DES}$ and $T_{CAT_OUTLET}$. A fuel determination module 216 determines a desired fuel value to inject into the exhaust gas based on the temperature increase value $T_{INCR}$. The desired fuel value is labeled uncorrected ($F_{DES_UNCORR}$) when a temperature error correction module 218 is present. The temperature error correction module 218 generates the desired fuel value ($F_{DES}$) based on $F_{DES_UNCORR}$.

For example only, the fuel determination module 216 may generate $F_{DES_UNCORR}$ based on the following equation:

$$F_{DES_UNCORR}=T_{INCR}\times N\ \text{PPM/}^\circ\ \text{C.}\times 1E\text{-}6\times(MAF_{EXH}/MW_{EXH})\times MW_{HC}$$

where N PPM/° C. is a predetermined number of fuel parts per million (PPM) required to raise the temperature of the exhaust gas by 1° C., $MW_{EXH}$ corresponds to the molecular weight of the exhaust gas, and $MW_{HC}$ corresponds to the molecular weight of hydrocarbon. For example only, N PPM/° C. can be calculated by the fuel determination module 216 and/or stored in tables. For example only, N PPM/° C. may be indexed based on $MAF_{EXH}$, ambient air temperature $T_{AMB}$, and/or other operating conditions. $MW_{EXH}$ and $MW_{HC}$ may be based on stored or calculated values and, in various implementations, may be stored constants.

The temperature error correction module 218 corrects $F_{DES_UNCORR}$ based on differences between the desired ($T_{PF_INLET_DES}$) and actual PF inlet temperature ($T_{PF_INLET}$). A summing module 220 generates a temperature error ($T_{ERR}$) signal based on a difference between $T_{PF_INLET_DES}$ and $T_{PF_INLET}$. An error control module 222 generates a fuel correction value ($F_{ERR_CORR}$) based on $T_{ERR}$. The error control module 222 may use a proportional, a proportional-integral, and/or a proportional-integral-derivative approach. For example only, the error control module 222 may generate $F_{ERR_CORR}$ based on the sum of an integration of $T_{ERR}$ and a scalar multiplication of $T_{ERR}$. A summing module 224 adds $F_{ERR_CORR}$ to $F_{DES_UNCORR}$ in order to generate $F_{DES}$.

During steady state operations, the fuel determination module 216 may adjust the N PPM/° C. value based on $F_{ERR_CORR}$. This may lead to more accurate values of $F_{DES_UNCORR}$ in the future. The desired fuel value $F_{DES}$ is output to the HCI control module 112, which generates HCI_Control for the HCI injector 60 based on the desired fuel value $F_{DES}$.

Figure 3:
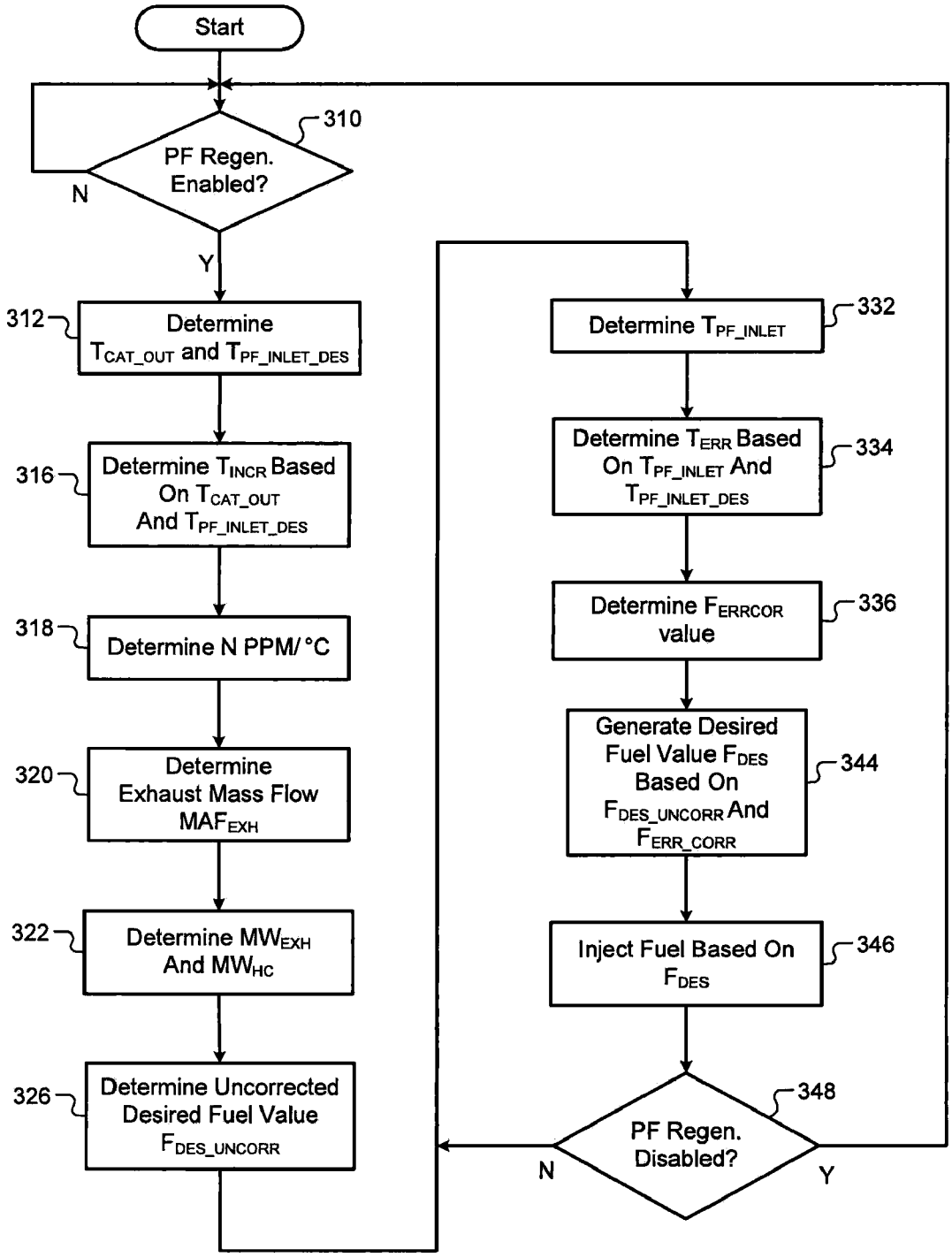
FIG. 3 is a flow diagram depicting a method for controlling the PF temperature according to the present disclosure.

With respect to FIG. 3, a flow diagram depicting a method for controlling the PF temperature during regeneration is shown. In step 310, control determines whether PF regeneration is desired. If so, control continues in step 312. If not, control remains in step 310. In step 312, control determines catalyst outlet temperature ($T_{CAT_OUT}$) and the temperature desired ($T_{PF_INLET_DES}$) for PF regeneration. In step 316, control determines the temperature increase $T_{INCR}$ based on $T_{SCR_OUT}$ and $T_{PF_INLET_DES}$.

In step 318, control determines N PPM/° C. In step 320, control determines the mass airflow of the exhaust ($MAF_{EXH}$). In step 322, control determines the molecular weight of the exhaust $MW_{EXH}$ and the hydrocarbon $MW_{HC}$. In step 326, control calculates an uncorrected desired fuel value ($F_{DES_UNCORR}$).

In step 332, control determines the PF inlet temperature ($T_{PF_INLET}$). In step 334, control determines the temperature error ($T_{ERR}$) based on the $T_{PF_INLET_DES}$ and $T_{PF_INLET}$. In step 336, control generates a fuel correction value $F_{ERR_CORR}$. In step 344, control generates the desired fuel value $F_{DES}$ based on $F_{DES_UNCORR}$ and $F_{ERR_CORR}$. In step 346, control injects fuel based on $F_{DES}$. In step 348, control determines if PF regeneration is disabled (for example, if regeneration is complete). If so, control returns to step 332. Otherwise, control returns to step 310.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. A control system comprising:

a first module that determines a temperature difference between a desired inlet temperature of a particulate filter (PF) and an outlet temperature of a first catalyst;

a fuel determination module that determines an uncorrected desired fuel value based on the temperature difference, an ambient temperature, and a mass flow of exhaust gas;

a temperature error correction module that generates a desired fuel value based on the uncorrected desired fuel value; and a hydrocarbon injection control module that controls a hydrocarbon injector based on the desired fuel value.

2. The control system of claim 1 wherein the mass airflow of the exhaust gas is based on the desired fuel value and a mass airflow value of intake air.

3. The control system of claim 1 wherein the fuel determination module generates the uncorrected desired fuel value based on:

$$T_{INCR}\times N\ \text{PPM/}^\circ\ \text{C.}\times 1E\text{-}6\times(MAF_{EXH}/MW_{EXH})\times MW_{HC}$$

wherein $T_{INCR}$ is the temperature difference, N PPM/° C. is a predetermined number of fuel parts per million (PPM) required to raise the temperature of the exhaust gas by 1° C., $MAF_{EXH}$ is the mass airflow of the exhaust gas, $MW_{EXH}$ is a molecular weight of the exhaust gas, and $MW_{HC}$ is a molecular weight of hydrocarbon.

4. The control system of claim 3 wherein the fuel determination module comprises a table outputting N PPM/° C., and wherein the table is indexed by at least one of $MAF_{EXH}$ and the ambient temperature.

5. The control system of claim 1 wherein the temperature error correction module generates an error value based on a difference between a measured inlet temperature of the PF and the desired inlet temperature.

6. The control system of claim 5 wherein the temperature error correction module generates a correction value based on the error value and generates the desired fuel value based on a sum of the uncorrected desired fuel value and the correction value.

7. The control system of claim 6 wherein the temperature error correction module generates the correction value using one of a proportional, a proportion-integral, and a proportional-integral-derivative approach.

8. The control system of claim 1 wherein the first catalyst is upstream of the PF, wherein a first oxidation catalyst is located between the first catalyst and the PF, and wherein the hydrocarbon injector injects hydrocarbons upstream of the oxidation catalyst.

9. A system comprising the control system of claim 8 and the first catalyst, wherein the first catalyst is one of a selective catalyst reduction (SCR) catalyst and a lean NOx trap.

10. The system of claim 9 further comprising a second oxidation catalyst arranged upstream from the first catalyst.

11. A method comprising:

determining a temperature difference between a desired inlet temperature of a particulate filter (PF) and an outlet temperature of a first catalyst;

determining an uncorrected desired fuel value based on the temperature difference, an ambient temperature, and a mass flow of exhaust gas;

generating a desired fuel value based on the uncorrected desired fuel value; and controlling a hydrocarbon injector based on the desired fuel value.

12. The method of claim 11 further comprising determining the mass airflow of the exhaust gas based on the desired fuel value and a mass airflow value of intake air.

13. The method of claim 11 further comprising generating the uncorrected desired fuel value based on:

$$T_{INCR} \times N \text{ PPM/° C.} \times 1E\text{-}6 \times (MAF_{EXH}/MW_{EXH}) \times MW_{HC}$$

wherein $T_{INCR}$ is the temperature difference, N PPM/° C. is a predetermined number of fuel parts per million (PPM) required to raise the temperature of the exhaust gas by 1° C., $MAF_{EXH}$ is the mass airflow of the exhaust gas, $MW_{EXH}$ is a molecular weight of the exhaust gas, and $MW_{HC}$ is a molecular weight of hydrocarbon.

14. The method of claim 13 further comprising storing a table outputting N PPM/° C., wherein the table is indexed by at least one of $MAF_{EXH}$ and the ambient temperature.

15. The method of claim 11 further comprising generating an error value based on a difference between a measured inlet temperature of the PF and the desired inlet temperature.

16. The method of claim 15 further comprising:

generating a correction value based on the error value; and generating the desired fuel value based on a sum of the uncorrected desired fuel value and the correction value.

17. The method of claim 16 further comprising generating the correction value using one of a proportional, a proportion-integral, and a proportional-integral-derivative approach.

18. The method of claim 11 wherein the first catalyst is upstream of the PF, wherein a first oxidation catalyst is located between the first catalyst and the PF, and wherein the hydrocarbon injector injects hydrocarbons upstream of the oxidation catalyst.

19. The method of claim 18 wherein the first catalyst is one of a selective catalyst reduction (SCR) catalyst and a lean NOx trap.

20. The method of claim 19 wherein a second oxidation catalyst is arranged upstream from the first catalyst.

* * * * *